United States Patent [19]

Veneklasen

[11] 3,962,542

[45] June 8, 1976

[54] CHORALIZER APPARATUS AND METHOD

[76] Inventor: Paul S. Veneklasen, 1711 16th St., Santa Monica, Calif. 90404

[22] Filed: Aug. 14, 1972

[21] Appl. No.: 280,192

Related U.S. Application Data

[63] Continuation of Ser. No. 44,348, June 8, 1970.

[52] U.S. Cl. ..... 179/1 J

[51] Int. Cl.² ..... H04R 3/00

[58] Field of Search ..... 179/1 J; 84/1.24, 1.25, 84/DIG. 4

[56] References Cited

UNITED STATES PATENTS

| | | | |
|---|---|---|---|
| 2,287,105 | 6/1942 | Kannenberg | 179/1 J X |
| 2,489,653 | 11/1949 | Leslie | 179/1 J X |
| 2,780,302 | 2/1957 | George | 84/1.25 |
| 3,204,722 | 9/1965 | Hare | 181/143 |
| 3,795,770 | 3/1974 | Kato | 179/1 J |

OTHER PUBLICATIONS

Tremaine: Practical Sound Engineering, Radio & Television News, June, 1951, pp. 66–68, 84, 86.

*Primary Examiner*—Douglas W. Olms
*Attorney, Agent, or Firm*—William W. Haefliger

[57] ABSTRACT

A choral effect is produced by operating a sound source element to produce sound traveling in a sound chamber, operating a sound detector element to detect sound traveling in the chamber, and, effecting movement of at least one of the elements so as to vary detected sound frequency and quality. A panel element may also (or alternatively) be moved to vary detected sound frequency and quality.

18 Claims, 4 Drawing Figures

FIG. 1.
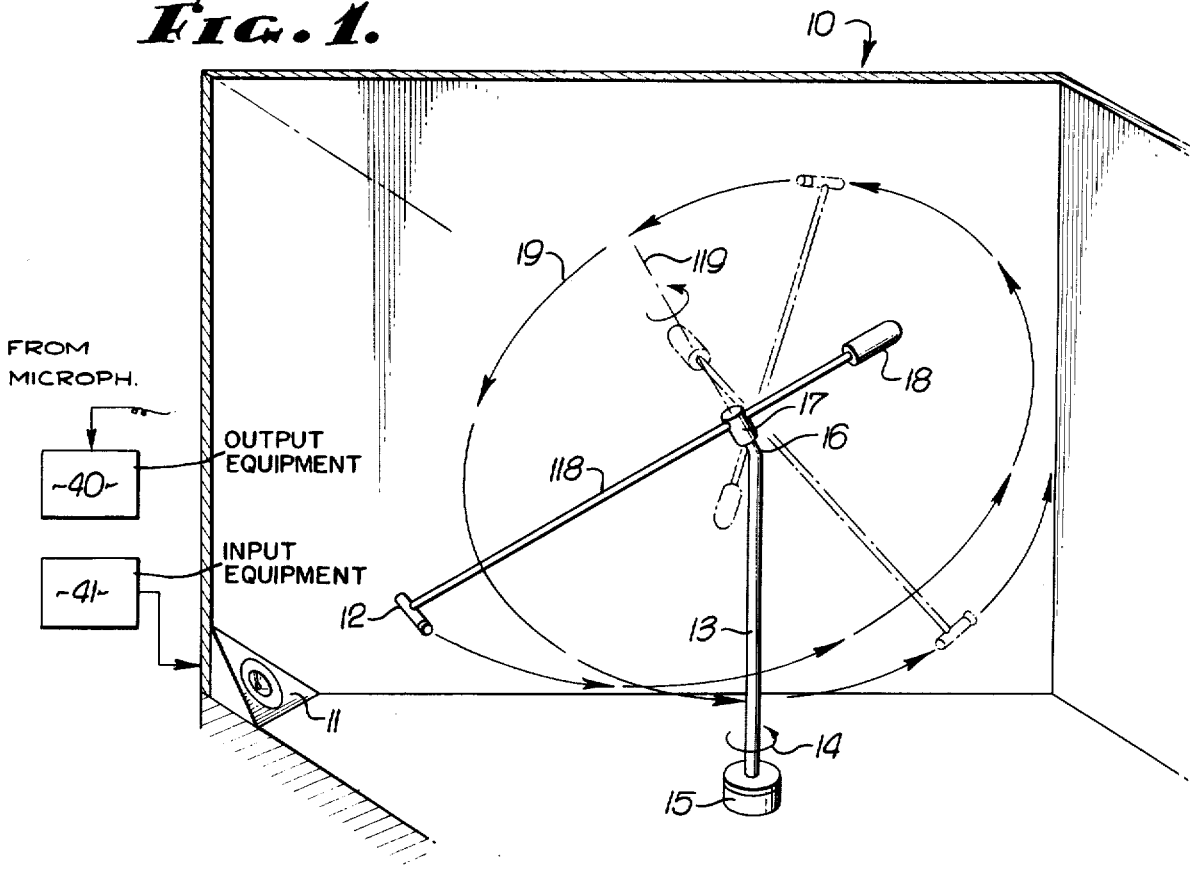
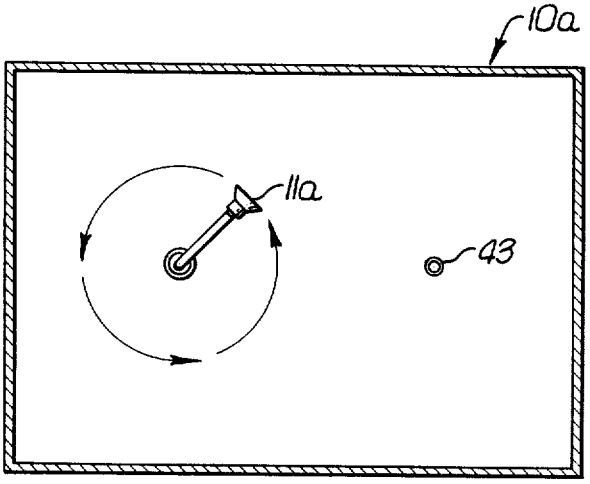
FIG. 4.
INVENTOR.
PAUL S. VENEKLASEN
By
White, Haefliger & Bachand
ATTORNEYS.

INVENTOR.
PAUL S. VENEKLASEN
By White, Haefliger & Bachand
ATTORNEYS.

CHORALIZER APPARATUS AND METHOD

This is a continuation of application Ser. No. 44,348, filed June 8, 1970.

BACKGROUND OF THE INVENTION

This invention relates generally to sound synthesis, and more particularly concerns choralizing method and apparatus wherein a tone is diffused into a family of tones within a narrow frequency band.

In music the distinction between a solo instrument and a group or section of the same instrument, i.e. a number of the same instrument playing in unison is an essential musical effect. Such a group we call a chorus of that instrument. Thus, the string section of an orchestra may consist of, say 16 first violins, 14 second violins, 12 violas, 10 cellos and 8 basses. This constitutes a string section chorus, and each group of the same instrument is a chorus of that instruction. Likewise, a vocal chorus may consist of 120 singers, performing in, say four or more parts. A violin section or chorus is easily distinguished from a single violin, even though heard at the same loudness. A four part chorus is easily distinguished from a vocal quartet.

The musical distinction may be likened to a tapestry, wherein the choral part is like a background, while the solo part is a detailed figure or design. Both design and background are necessary; both solo and chorus are useful.

In many cases of musical ensemble, the size of group must be reduced, either because of the cost of the performers, or because of the size of the performing space, as in an orchestra pit in a theater, or in a small recording studio. Thus, for example, a normal string section of 60 may be reduced to 15 players. The loss of volume may be recovered by amplification. But the loss of chorus effect cannot generally be recovered. The difference in sound beween 8 cellos and 2 can be easily detected. It would be very desirable to recover the chorus effect. Furthermore, one never hears, for example, a chorus of oboes, and the effect might be very useful musically. Thus, new and interesting musical effects may be made available by a choralizing process.

The distinction between a chorus and a solo instrument is physically explained. Ten violins playing in unison do not play exactly the same pitch; nor do any two have exactly the same quality. Thus, a very complex beating effect between each instrument and all others is set up, wherein each instrument loses its individual identity and a sort of shimmering effect occurs, wherein one hears the same musical progression or melody, and recognizes the quality of the instrument, but loses the solo nature.

SUMMARY OF THE INVENTION

The objective of this invention, therefore, is to start with a single instrument playing a musical part, and cause it to sound like a chorus of many instruments playing the same part. To accomplish this in a realistic manner, i.e. to synthesize the chorus, one must split the sound of the one instrument at any given instant of time, when a single tone is being played, into a group of tones all having different frequencies, differing from the original frequency by a small amount, and qualities or timbres differing slightly from that of the original instrument. This synthesis may be accomplished in the following manner, which is explained in two steps:

Suppose a given tone of frequency $f_o$ is played into a tube of such length that a standing wave resonance is set up. The length of the tube will then be $L = n\lambda$, where n waves of wavelength $\lambda$ are within the tube. Such a standing wave resonance actually consists of two traveling waves, traveling in opposite directions in the tube, so that they reinforce or cancel one another, and the resulting pattern appears to be stationary. Each of the traveling waves travels at a velocity C, and the frequency $f_o$ is $C/\lambda$. Now suppose that a microphone is placed in the tube to detect the sound. The electrical signal coming from the microphone will have a frequency $f_o$. However, if the microphone is caused to move along the tube at a velocity V, it will be observed that the frequency $f_o$ gives way to two frequencies $f_1$ and $f_2$, slightly separated — one higher and one lower than $f_o$. The reason is that the microphone is moving in the same direction as one of the two traveling waves, and counter to the direction of the other. The new frequencies will be $$f_1 = \frac{C + V}{\lambda}$$

and $$f_2 = \frac{C - V}{\lambda}$$

and the frequency deviation $\Delta f = f_1 - f_o = f_o\ V/C$; $f_2 - f_o = -f_o V/C$ or the resulting separation between the two new tones is $2f_oV/C$.

Since a tone will in general have many harmonics, $f_o, 2f_o 3f_o$, etc., and each harmonic has a shorter wavelength, i.e.

$$2f_o = \frac{2C}{\lambda 0},$$

etc., the frequency deviation of each harmonic is related to that of the fundamental tone so that harmonics of the deviated frequencies remain harmonic.

Similarly, as the microphone moves, it passes alternately through maxima and minima values of sound pressure in the standing wave, but in general the nodes of the various harmonics occur at different places in the tube, so that the tone also changes quality, as well as pitch as the microphone moves.

While this description illustrates the essential behavior of the system, a tube, or linear acoustical system, would be much too simple and obvious a result, producing only two tones of periodic variation. Therefore, the preferred process uses a three dimensional acoustical system, namely a room having dissimilar dimensions.

Any three dimensional room has a great many resonant acoustical modes. Any tone produced in a room will excite into simultaneous sounding a great many of these resonances, not only one at exactly the exciting frequency, but also many modes having nearby frequencies, depending on the acoustical damping or obsorption in the room. Each of these standing waves in turn consists of two traveling waves in opposite directions. Also, each of the resonant modes has a specific direction of propagation, and all the excited modes have different directions. As a microphone moves in the room in which a tone is playing, its motion with respect to each of these resonant modes produces two new tones, separated slightly in frequency and of slightly different quality. The frequency deviation of the new tones depends on the velocity of the microphone with respect to the direction of propagation of the resonant wave. Since there are at any instant many such modes and waves, the path of the microphone will have a different direction and relative velocity with respect to each wave system. Therefore, many pairs of tones are created with many frequency variations, all within a maximum deviation corresponding to the chance alignment of the microphone velocity direction with the direction of a particular wave, for which $\Delta f = f_o V/C$. For all other waves, if $\phi$ is the relative direction of the microphone velocity with respect to the propagation direction of the wave, the frequency deviation will be $\Delta f = f_o\ V/C \cos \phi$. The result is thus a vast array of tones of slightly differing frequency and quality, in exactly the same case as with an actual chorus of tones.

Another property must be added for a practical system. Since the microphone cannot travel far in one direction in a room, it is useful to let the microphone move in a circular path, as for example at the end of a rotating arm. In this case, the instantaneous velocity of the microphone is continually changing direction with respect to the propagation direction of all the resonant wave systems in the room. However, the frequency bandwidth of all the derived tones is no different and the desired effect is preserved.

However, a secondary effect occurs which is less than optimal; as the microphone moves in a circular path, its proximity to the six walls of the room changes periodically, with the period of the microphone rotation. While this effect cannot generally be detected in a melodic line of music, it can often be detected in sustained notes or tones. This effect may be diminished by also rotating the axis about which the microphone is rotating, so that the microphone travels in a form of spiral pattern, eliminating the regular periodicity of its movement with respect to the walls of the room.

Still another method exists for creating the desired effect. If a sound source and microphone are stationary in a room and a large surface or panel is rotated in the room, a complex variation of the resonant waves in the room results. The effect may be explained and shown to be similar to the first explained method as follows: At any instant the wave coming from the source and impinging upon the panel is reflected and the microphone will sense both the direct and the reflected waves, one coming from the source and the other being reflected and arriving as if it originated from the familiar image source caused by the reflector. Now, if the reflector is moving the image source is also moving with respect to the microphone, and if the panel is approaching the microphone at a velocity w, the image source will be approaching at a speed 2w, generating a frequency deviation for the image source of $f = 2f_o\ w/C$. When the panel moves in a room there are first a great many fixed image sources, for example six caused by first reflections of the original source from the six room surfaces, and then for these fixed images the panel will create six moving image sources. This is a simplified explanation for far more complex phenomena occurring in the room because in actuality the frequencies and directions of the complex array of resonant acoustical modes in the room are also constantly changing. The result is essentially the same as with the rotating microphone, namely that a single tone is diffused into a family of tones within a narrow frequency band, constituting the choralizing process.

The two methods may also be combined into a single process, i.e. a microphone may be rotated on an arm about some axis while also a large panel is rotated. In a large room the two rotating devices may be spacially separated so as to avoid mutual interference. In a smaller room, both microphone and panel can rotate together, as for example if the plane of rotation of the microphone arm remains in fixed relation to the plane or surface of the panel, and they rotate together. In this case again the microphone moves in a sort of spiral path while the reflecting panel also moves with respect to the sound source. Again, the acoustical result is the same and the choralizing effect is achieved.

Basically, then, the process of synthesizing a choral effect by using a sound chamber in accordance with the invention involves the steps of:

a. operating a sound source to produce sound traveling in the chamber, b. operating a sound detector element to detect sound traveling in the chamber, and c. effecting movement of at least one of said elements so as to vary detected sound frequency and quality.

More specifically, the sound detection element may be rotated or otherwise moved in a closed path in the chamber; or a sound reflecting panel element may be so moved in the chamber; or both the sound detection and panel elements may be so moved in the chamber; or the sound source element may be so moved in the chamber.

In its apparatus aspect, the invention comprises a sound chamber in which a sound reflecting panel element may be located; a source sound element for producing sound to be reflected from the panel element; a sound detector element located to detect sound traveling in the chamber; and means for effecting movement of at least one of the elements so as to vary detected sound frequency and quality. The latter means may include a rotary drive operatively connected with one or more of the elements, as will be seen. Further, the drive may include first and second rotors (such as arms) rotatable about separate axes; the second rotor carried by the first; the drive may be connected to a sound reflecting rotary panel; and the sound detecting element (such as a microphone) may be carried to rotate with and relative to that panel.

The maximum frequency deviation is controlled by changing the speed of the microphone movement. A typical speed for good effect has been found to be about thirty feet per second, although a lesser value may be used for more moderate choralization, or a greater value may be used for certain dramatic effects. The degree is a matter of artistic taste.

It has been apparent, since the preferred method involves the sound in an enclosed space or sound chamber, that a certain amount of reverberation accompanies the process. Indeed, it is the existence of reverberant modes in a chamber that produces the choralizing effect and also the reverberation phenomenon. The degree of reverberation is separately adjustable. Artistically, it is appropriate that the choralized sound should also be reverberant. It is also advisable to shield the microphone path from the direct sound of the loud speaker.

These and other objects and advantages of the invention, as well as the details of illustrative embodiments, will be more fully understood from the following specification and drawings, in which:

DRAWING DESCRIPTION

FIG. 1 is a perspective showing of one form of apparatus and method embodying the invention;

FIG. 4 is a plan view of a modified arrangement.

DETAILED DESCRIPTION

Figure 2:
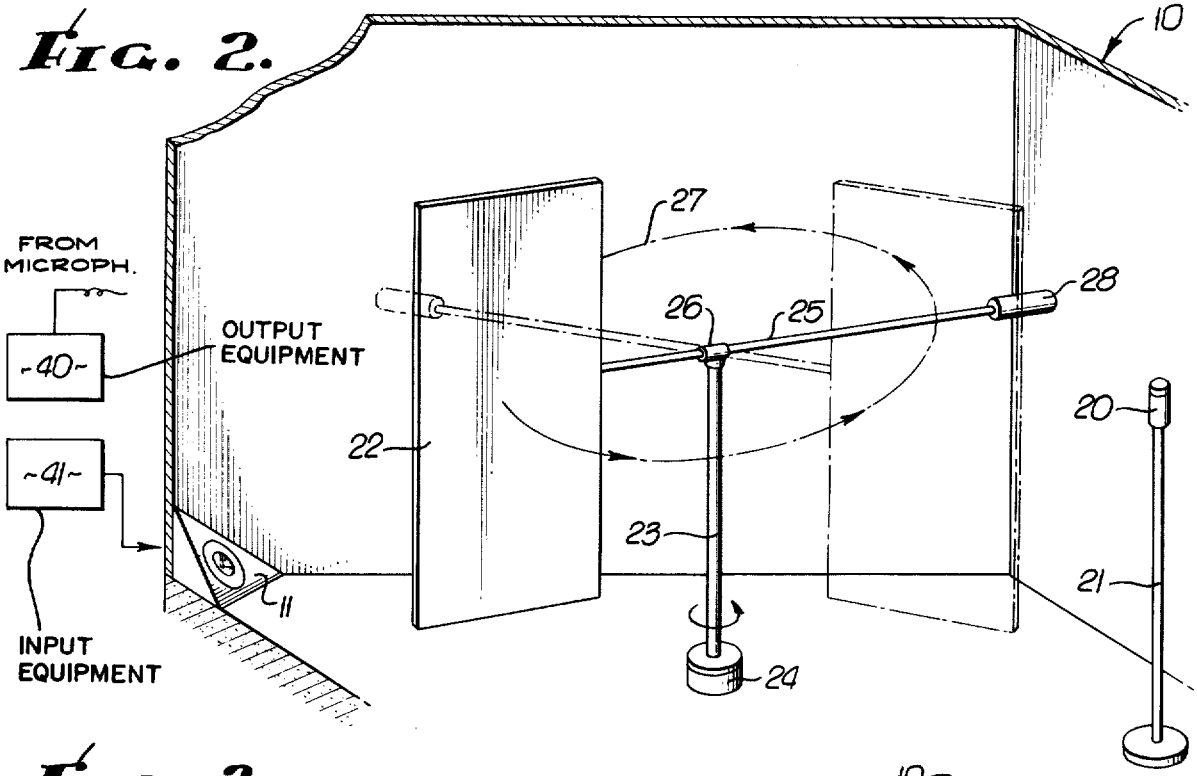
FIG. 2 is a perspective showing of a modified form of apparatus and method embodying the invention.

Referring to FIG. 1, a sound chamber 10 is shown as including four walls, a ceiling and floor, the length, width and height dimensions of the chamber preferably being dissimilar. The walls, ceiling and floor may be considered to define sound reflecting surfaces or elements exposed to the chamber interior for reflecting sound in the chamber. A sound source element may, for example, be defined by a loudspeaker 11 located in a corner of the chamber.

A sound detector element, as for example a microphone 12 is located to detect sound traveling in the chamber, whether that sound is transmitted directly from the loudspeaker or is reflected from one or more of the surface elements. Furthermore, means is provided for effecting movement of at least one of the elements (i.e. detector element or source element) so as to vary detected sound frequency and quality, as previously described. Such means in FIG. 1 takes the form of a rotary drive operatively connected with the sound detector element, i.e. microphone 12, the drive including an upright shaft 13 rotated about its axis as indicated by arrow 14, and a power unit 15 to rotate the shaft. The shaft is angled at 16, and mounts a rotary drive unit 17 for an elongated rod 118, whereby the rod may also be rotated about an axis 119 angled from vertical.

The microphone 12 is carried at one end of the rod, and a counterweight 18 is carried at the opposite end of the rod 118. Accordingly, a spiral path 19 is traced by the microphone in its rotary travel about the axis of shaft 13 and about the axis 119. This combination effect can be controlled or varied by changing the angular velocity of the two rotations; thus, the choralizing effect described previously may be produced by simple apparatus and method.

In FIG. 2, the chamber 10 and loudspeaker 11 are the same as in FIG. 1. Microphone 10 is in this case mounted on a pedestal 21 to remain in fixed, spaced relation to the loudspeaker. A sound reflecting panel element, defined by upright panel or baffle 22, is moved cyclically within the chamber, as for example by a rotary drive, to effect production of the choralizing effect, as described in the introduction. Such cyclic movement may be produced by a rotary drive including a shaft 23 and a rotary power unit 24. The baffle or panel 22 is carried at one end of a rod 25 supported at 26 by the shaft 23 so that the baffle rotates in an arc 27. The opposite end of the rod carries a counterweight 28.

Figure 3:
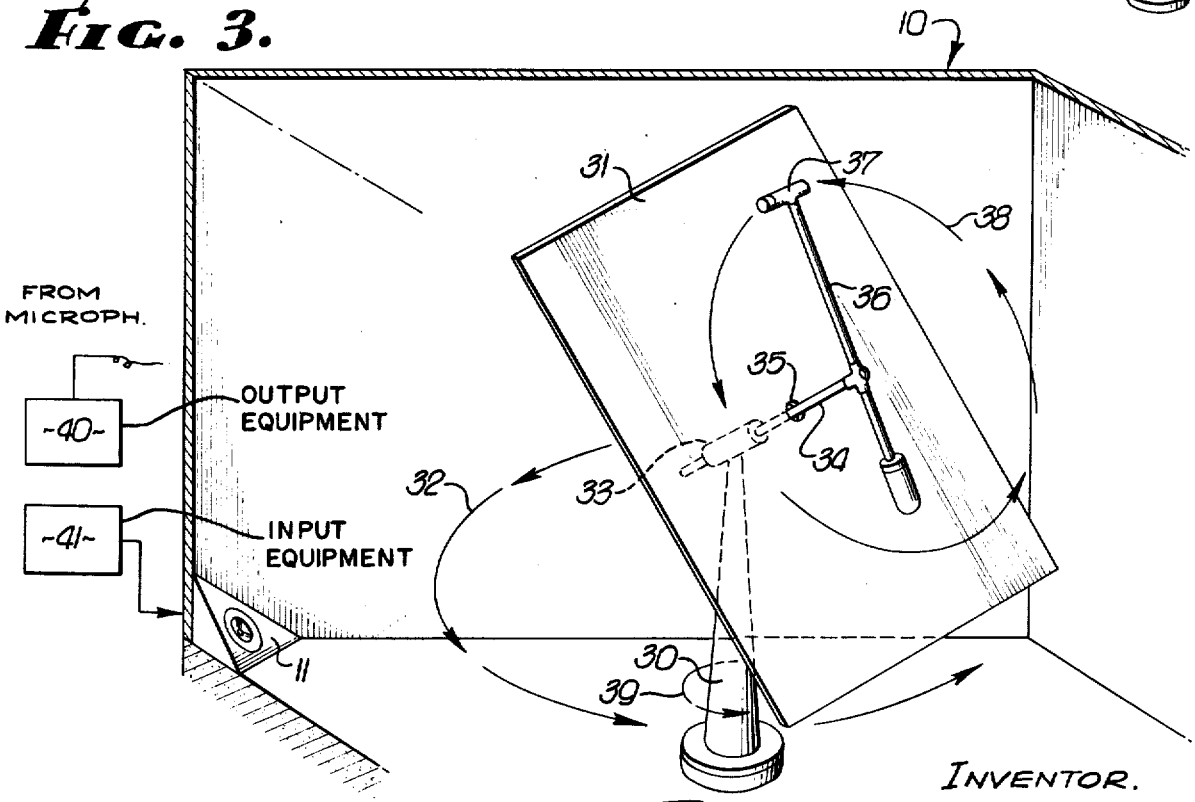
FIG. 3 is a perspective showing of yet another form of apparatus and method embodying the invention.

In FIG. 3, the chamber 10 and loudspeaker 11 remain the same as in FIG. 1. A pedestal 30 is rotated by suitable means to effect rotation of a baffle 31 in an arc indicated at 32. The baffle or panel is angled from the vertical, and is supported by a housing 33 carried at the top of the pedestal.

Housing 33 may contain a drive unit for rotating a shaft 34 projecting generally perpendicularly through the baffle, at 35. The shaft carries an arm 36 which in turn carries a microphone 37 to be rotated by the shaft and arm in an arc 38. Thus, the microphone cyclic motion is defined by compounding the rotary motion or the pedestal, indicated by arrow 39, about a vertical axis with the rotary motion indicated by arrow 38 about the axis of shaft 34. The microphone moves in a form of resultant spiral to eliminate or reduce the sustained periodicity of single tones detected by the microphone, while achieving the desired choralizing effect.

In each of FIGS. 1–3, the block 40 indicates a recording unit which may be used as by electrical connection to the microphone for recording the choralized music. Block 40 may also represent a loudspeaker. Block 41 represents a source of music to be subjected to choralizing and is electrically connected to the speaker 11. Multiple speakers may be used at different locations in the chamber if desired. Alternatively, the speaker 11a or speakers may be subjected to cyclic movement, as schematically shown in FIG. 4, while the microphone 43 is held stationary in the chamber 10a.

The movement referred to above may be rotary, linearly oscillatory, ellipsoidal, spiral, or have other repetitive or closed path. Also, the degree of reverberation of the chamber is adjustable, as by adjusting the acoustic absorption of the walls.

I claim:

1. The process of synthesizing a choral effect by using a sound chamber and an elongated arm to be rotated about an axis extending at an angle relative to the arm, that includes a. operating a sound source element to produce sound traveling in the chamber, b. supporting a sound detector element at an outboard end portion of the arm relative to said axis, and operating said sound detector element to detect sound traveling in the chamber, and c. effecting continuous sweeping movement of said arm and sound detector element thereon and about said axis to carry the sound detector through a sweeping path relative to said source element and relative to the chamber, while maintaining the source element in fixed position relative to the chamber so as to vary detected sound frequency and quality.

2. The process of claim 1 wherein the arm is rotated in the chamber.

3. The process of claim 1 wherein said movement is cyclic.

4. The process of synthesizing a choral effect by using a sound chamber in which a sound reflecting panel element is located, that includes a. producing sound from a source element to be reflected from said panel element, b. operating a sound detector element to detect sound traveling in the chamber, c. effecting continuous movement of the panel element relative to said source element and relative to the chamber while keeping the source element in fixed position relative to the chamber so as to vary detected sound frequency and quality, and also effecting continuous movement of the sound detector element in the chamber.

5. The process of claim 4 wherein the panel element is rotated in the chamber.

6. The process of claim 4 including the step of varying the velocity of said panel element.

7. The process of synthesizing a choral effect by using a sound chamber in which a sound reflecting panel element is located, that includes a. producing sound from a source element to be reflected from said panel element, b. operating a sound detector element to detect sound traveling in the chamber, and c. effecting continuous rotation of the sound detector element and the panel element in the chamber so that the sound detector element is moved along a sweeping path remotely from an axis about which the detector element is rotated, while keeping the source element in fixed position relative to the chamber so as to vary detected sound frequency and quality, the panel element being rotated relative to the source element and relative to the chamber.

8. The process of synthesizing a choral effect by using a sound chamber in which a sound reflecting panel element is located, that includes a. producing sound from a source element to be reflecting from said panel element, b. operating a sound detector element to detect sound traveling in the chamber, and c. effecting continuous rotation of the sound detector and panel elements about the same axis and relative to the sound source, and also simultaneously effecting continuous movement of one of the sound detector and panel elements relative to the other, so as to vary detected sound frequency and quality.

9. The process of claim 8 wherein the sound detector is rotated relative to the panel element and about another axis generally perpendicular to a plane defined by the surface of said panel element.

10. The process of synthesizing a choral effect by using a sound chamber, that includes a. operating a sound source element to produce sound traveling in the chamber, b. operating a sound detector element to detect sound traveling in the chamber, and c. effecting continuous non-circular movement of the sound detector repeatedly into different portions of the chamber and relative to the source element while maintaining the source element in fixed position relative to the chamber so as to vary detected sound frequency and quality.

11. Apparatus for synthesizing a choral effect, comprising a. a sound chamber, b. a sound source element having fixed position relative to the chamber for producing sound to travel in the chamber, c. a sound detector element located to detect sound traveling in said chamber, and d. means for effecting continuous movement of said sound detector element relative to said source element and chamber so as to vary detected sound frequency and quality, said means including an elongated arm rotatable about an axis extending at an angle relative to the arm, and said detector element being carried by an outboard portion of the arm relative to said axis to be bodily moved through a sweeping path in the chamber in response to arm rotation about said axis.

12. Apparatus as defined in claim 11 wherein said last named means includes a rotary drive operatively connected with said arm.

13. Apparatus as defined in claim 11 including a sound reflecting panel element in the chamber, said last named means including a rotary drive operatively connected with said panel element.

14. Apparatus as defined in claim 11 wherein the chamber is bounded by at least four plane surfaces.

15. Apparatus for synthesizing a choral effect, comprising a. a sound chamber, b. a sound source element having a fixed position relative to the chamber, c. a sound detector element located to detect sound traveling in said chamber, d. a sound reflecting panel element in the chamber, and e. means for effecting continuous rotation of the sound detector and panel elements and relative to the sound source, and for simultaneously effecting continuous movement of one of the sound detector and panel elements relative to the other, so as to vary sound frequency and quality, the sound detector element having an axis of rotation substantially perpendicular to said panel.

16. Apparatus for synthesizing a choral effect, comprising a. a sound chamber, b. a sound source element having a fixed position relative to the chamber, c. a sound detector element located to detect sound traveling in said chamber, d. a sound reflecting panel element in the chamber, and e. means for effecting continuous movement of the panel element and the sound detector element and relative to the sound source so as to vary sound frequency and quality.

17. Apparatus for synthesizing a choral effect, comprising a. a sound chamber, b. a sound source element having fixed position relative to the chamber for producing sound to travel in the chamber, c. a sound detector element located to detect sound traveling in said chamber, and d. means for effecting continuous movement of said sound detector element relative to said source element and chamber so as to vary detected sound frequency and quality, said means including a rotary drive operatively connected with said source detector element, the rotary drive including a first rotor rotatable about a first axis, and a second rotor carried by the first rotor and rotatable about a second axis offset from the first axis.

18. The process of synthesizing a choral effect by using a sound chamber, that includes a. operating a sound source element to produce sound traveling in the chamber, b. operating a sound detector element to detect sound traveling in the chamber, and c. effecting continuous movement of said sound detector element about separate axes and relative to the source element so as to vary sound frequency and quality.

* * * * *